US011272795B2

(12) United States Patent
Landgren

(10) Patent No.: US 11,272,795 B2
(45) Date of Patent: Mar. 15, 2022

(54) STORAGE SYSTEM

(71) Applicant: Carl Landgren, Milwaukee, WI (US)

(72) Inventor: Carl Landgren, Milwaukee, WI (US)

( * ) Notice: Subject to any disclaimer, the term of this patent is extended or adjusted under 35 U.S.C. 154(b) by 0 days.

(21) Appl. No.: 16/798,802

(22) Filed: Feb. 24, 2020

(65) Prior Publication Data

US 2020/0268176 A1 Aug. 27, 2020

Related U.S. Application Data

(60) Provisional application No. 62/808,952, filed on Feb. 22, 2019.

(51) Int. Cl.
*A47F 5/08* (2006.01)
*A47B 96/06* (2006.01)

(52) U.S. Cl.
CPC ..... *A47F 5/0853* (2013.01); *A47B 96/067* (2013.01)

(58) Field of Classification Search
CPC ..... A47F 5/0853; A47B 96/067; A47B 57/42; A47B 57/425
See application file for complete search history.

(56) References Cited

U.S. PATENT DOCUMENTS 813,501 A * 2/1906 Keil ..... A47B 57/42 248/243
2,553,960 A * 5/1951 De Swart ..... A47B 57/425 248/250
3,092,047 A * 6/1963 Chesley ..... A47B 57/42 108/137
3,242,886 A * 3/1966 Chesley ..... A47B 57/42 108/152
3,353,684 A * 11/1967 Chesley ..... A47B 57/42 211/187
3,355,134 A * 11/1967 Chesley ..... A47B 96/025 248/250
3,565,381 A * 2/1971 Oliver ..... A47B 57/42 248/243
3,730,108 A * 5/1973 Stroh ..... A47B 45/00 108/108
3,871,144 A * 3/1975 Rudin ..... A47B 57/42 52/36.5
3,993,002 A * 11/1976 Stroh ..... A47F 5/13 108/108
D257,950 S * 1/1981 Van Meter, Jr. ..... D13/154
4,327,888 A * 5/1982 Scheneman ..... A47F 5/0823 248/220.43
D279,959 S * 8/1985 Nimmo ..... D8/382
4,624,376 A * 11/1986 Bertram ..... A47B 96/028 108/152
4,966,343 A * 10/1990 Bessinger ..... A47B 57/42 108/108

(Continued)

FOREIGN PATENT DOCUMENTS

CH 352475 A * 2/1961 ..... A47B 57/425
DE 2824605 A1 * 12/1979 ..... A47B 57/42

(Continued)

*Primary Examiner* — Stanton L Krycinski
(74) *Attorney, Agent, or Firm* — Boyle Fredrickson S.C.

(57) ABSTRACT

A storage system includes a slatwall panel having a number of elongate horizontal slots disposed between flat panels that enables various support assemblies to be engaged within the slots to hold the support on the panel, thereby enabling the support assembly to support items thereon in a horizontal orientation.

12 Claims, 8 Drawing Sheets

(56) References Cited

U.S. PATENT DOCUMENTS 5,297,486 A * 3/1994 Herrmann ..... A47B 96/028 108/108
5,580,018 A * 12/1996 Remmers ..... A47B 55/02 108/152
5,941,026 A 8/1999 Eisenreich et al.
6,024,333 A * 2/2000 Raasch ..... A47B 55/02 211/134
6,050,426 A * 4/2000 Leurdijk ..... A47B 96/067 211/57.1
6,561,474 B1 * 5/2003 Walter ..... A47F 5/0815 211/94.01
6,932,225 B2 * 8/2005 Rowe ..... A47B 57/30 211/90.02
7,240,803 B2 * 7/2007 Stitchick ..... A47B 47/022 211/106
7,407,060 B2 * 8/2008 Swartz ..... A47B 96/067 211/190
D578,869 S * 10/2008 Fernandez ..... D8/354
7,866,492 B2 * 1/2011 Walter ..... A47F 5/0815 211/103
10,051,978 B2 * 8/2018 Gupta ..... A47B 96/061
10,376,059 B1 * 8/2019 Ebersole ..... A47B 96/021
D858,256 S * 9/2019 Smith ..... D8/354
2006/0011568 A1 * 1/2006 Remmers ..... A47B 96/028 211/94.01
2020/0146450 A1 * 5/2020 LeBlanc ..... A47B 96/067

FOREIGN PATENT DOCUMENTS

EP 2292120 A1 * 3/2011 ..... H01R 25/14
GB 1234777 A * 6/1971 ..... A47B 57/425
WO WO-2014111261 A1 * 7/2014 ..... A47B 96/066

* cited by examiner

STORAGE SYSTEM

CROSS-REFERENCE TO RELATED APPLICATIONS

This application claims priority from U.S. Provisional Patent Application Ser. No. 62/808,952, filed on Feb. 22, 2019, the entirety of which is expressly incorporated herein by reference for all purposes.

FIELD OF THE INVENTION

The present invention relates generally to storage systems, and more specifically to storage systems including a vertical wall and support members engaged with the wall to hold items thereon.

BACKGROUND OF THE INVENTION

In the area of storage systems, one type of storage system includes a slatwall panel disposed vertically on one or more surfaces on which items are to be stored or displayed. The slatwall includes a number of elongate horizontal slots spaced along the length of the slatwall panel and disposed between separate flat sections of the panels. The slots have a configuration that enables various supports to be engaged within the slots to hold the support on the panel without the need for any additional engagement members or structures, thereby providing an easy to assemble construction for supporting members on the wall. The supports can also be connected to a variety of different types of organizing devices or structures that provide the panel with a multitude of customizable organizing configurations.

The panels can be located on multiple vertical surfaces, such as on adjacent walls or on interior surfaces within a cabinet, and allow for the customization of the location and arrangement of the supports and associated organizing devices or structures thereon in any desired manner.

The supports engaged with the slatwall panel are formed as rods that extend outwardly at an angle generally perpendicular to the panel, such that the supports enable the items supported or displayed thereon to hang vertically from the supports.

However, while many items are able to be hung directly from the rods supported by the panel, such as through the use of apertures in the item or formed within packaging for the item, many items to be held or displayed require being disposed in a horizontal position which cannot be accommodated by prior art supports utilized with slatwall panels.

Therefore, it is desirable to develop an improved solution for the organization and storage of items in a horizontal orientation on a slatwall panel to address these issues with the prior art.

SUMMARY OF THE INVENTION

According to one aspect of an exemplary embodiment of the invention, a support for a slatwall panel includes a bracket engageable with the slot on the panel and a rod extending outwardly from the bracket. The rod includes a number of apertures disposed therein that receive connecting tabs disposed on positioning clips disposed on the rods. The clips, opposite the tabs, include engagement members that receive and engage portions of a shelf to reliably secure the shelf to the clip(s) and to and between the rods. With this configuration the shelf can be secured held in a horizontal position on the slatwall, thus enabling various items to be disposed in a horizontal configuration on the slatwall for storage and/or display.

According to still a further aspect of the invention, the support includes a securing patch on the bracket opposite the rod. The securing patch engages the flat portion of the slatwall immediately adjacent the bracket. The securing patch releasably holds the bracket against the flat portion of the slatwall to prevent the bracket from sliding along the slot with regard to the slatwall.

These and other aspects, features and advantages of the invention will be made apparent from the following detailed description taken together with the drawing figures.

BRIEF DESCRIPTION OF THE DRAWINGS

The drawings illustrate the best mode currently contemplated of practicing the present invention.

In the drawings.

DETAILED DESCRIPTION OF THE INVENTION

Before the present compositions, apparatuses and methods are described, it is understood that this invention is not limited to the particular embodiments and methodology, as these may vary. It is also to be understood that the terminology used herein is for the purpose of describing particular exemplary embodiments only, and is not intended to limit the scope of the present invention which will be limited only by the appended claims.

Figure 1:
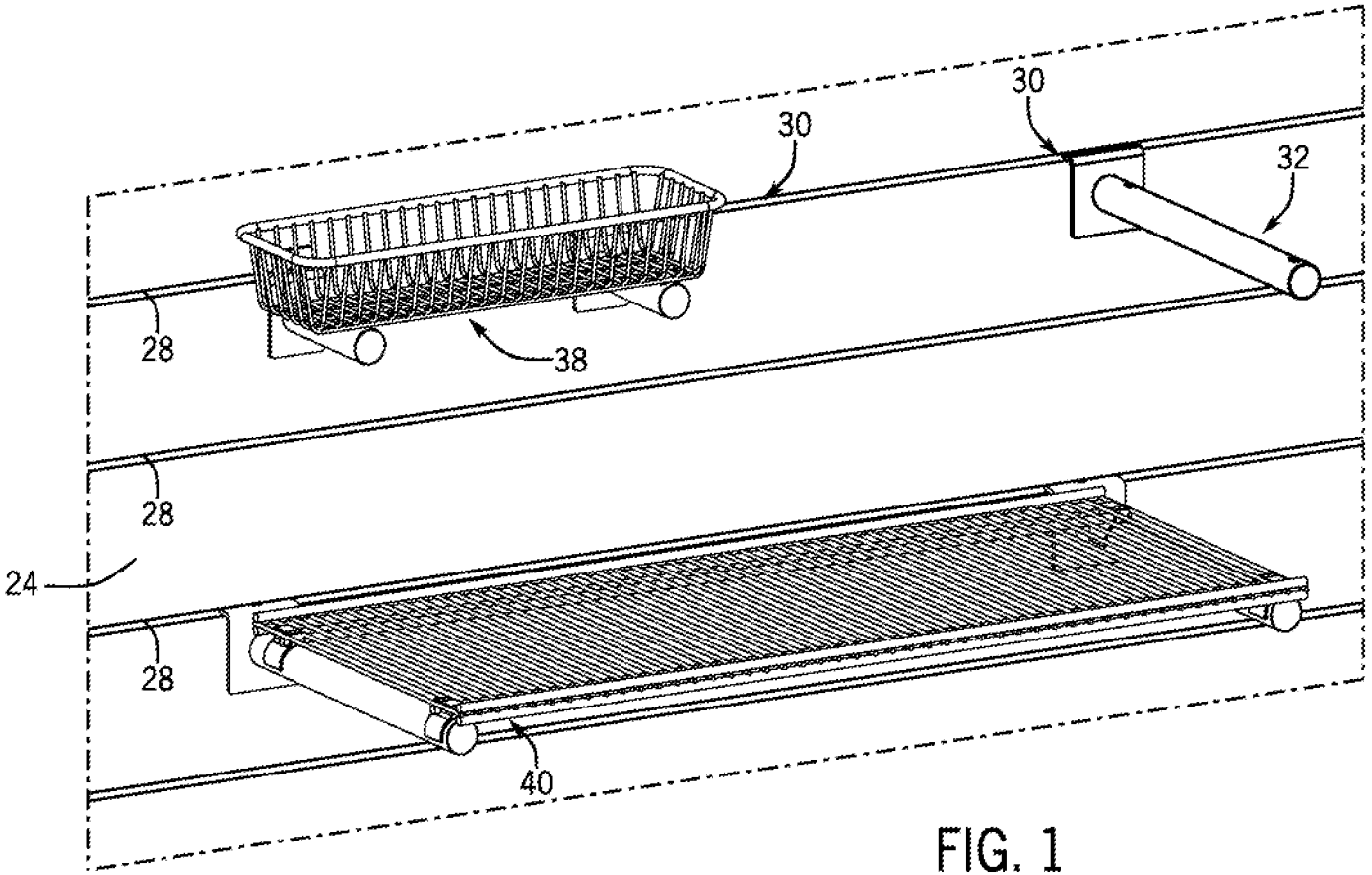
FIG. 1 is a perspective view of one embodiment of the slatwall storage system of the invention.
Figure 2:
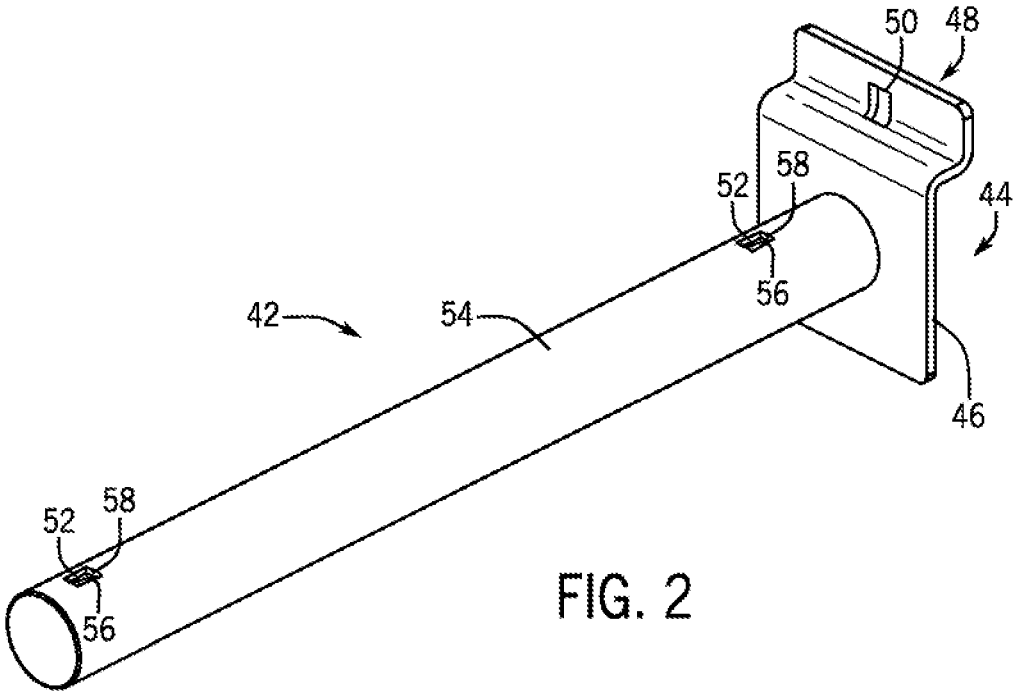
FIG. 2 is an isometric view of one embodiment of a support rod used with the slatwall storage system of FIG. 1

Referring now to FIG. 1, a support system formed according to one exemplary embodiment of the present invention is shown at 10. In the illustrated embodiment, the support system 10 includes a wall panel 24. The wall panel 24 can have any desired configuration, but in one exemplary embodiment the panel 24 has a configuration corresponding to the panel disclosed in U.S. Pat. No. 5,941,026, entitled Slatwall Display System, which is hereby expressly incorporated by reference in its entirety for all purposes. The panel 24 includes a number of slots 26 extending horizontally across the panel 24 which each include an undercut or channel (not shown) along the upper edge of the slot 26.

The panel(s) 24 do not have any other structures formed or disposed on them other than the slots 26, such that the very low profile of the panels 24 does not intrude into the space within which the panel 24 is disposed. Thus, the panels 24 allow for virtually any arrangement of support assemblies 30 to be secured to the panel 24 to hold items thereon.

As shown in FIG. 1, some exemplary embodiments of the support assemblies 30 that can be attached to the panels 24 in varying configurations include straight or angled hooks or rod assemblies 32, basket assemblies 38, and shelf assemblies 40, among other suitable structures 30. In certain exemplary embodiments, the structures 30 can have solid constructions or can be formed of a hollow or mesh-like material in order reduce the weight of the structures 30. In addition, in exemplary embodiments the components 30 are formed of a generally rigid material, such as a metal or hard plastic, in order to enable the structures 30 to provide the desired strength to the structures 30.

Looking now at FIGS. 1-11, for the shelf assembly 40, the assembly 40 includes a number of support rods 42 each including a bracket 44 at one end. The bracket 44 includes a base 46 secured to the rod 42 in any suitable manner, such as by integrally molding the base 46 with the rod 42 or adhesively connecting or welding the base 46 to the rod 42, depending upon the material utilized to form the rod 42 and the bracket 44. The bracket 44 also includes one or more tabs 48 extending outwardly from an upper end of the base 46. The tab(s) 48 are shaped with a configuration, such as a generally L-shaped configuration, that can be engaged with the slots 26 in panels 24, such as by partially inserting the tab 48 into the channel above the slot 26 to engage the tab 48 with the channel while allowing the weight of the bracket 44 to pull the tab 48 onto the lower edge of the slot 26 while the tab 48 remains engaged within the channel to hold the base 46 in a secure position flush against the panel 24 below the selected slot 26. The bracket 44 can additionally include an aperture 50 disposed in the tab 48 for alignment purposes when securing the bracket 44 to the panels 24.

Figure 3:
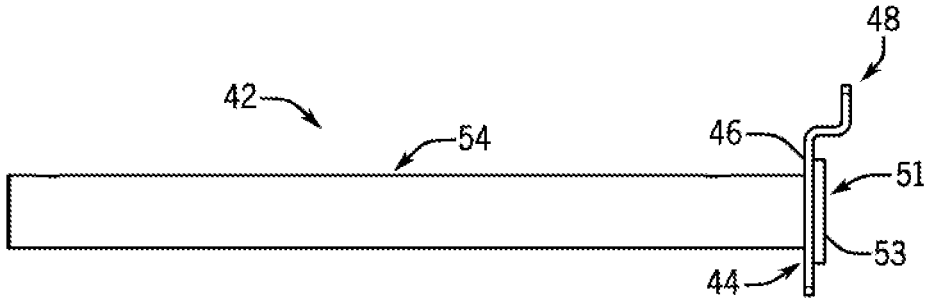
FIG. 3 is a side plan view of the support rod of FIG. 1.
Figure 4:
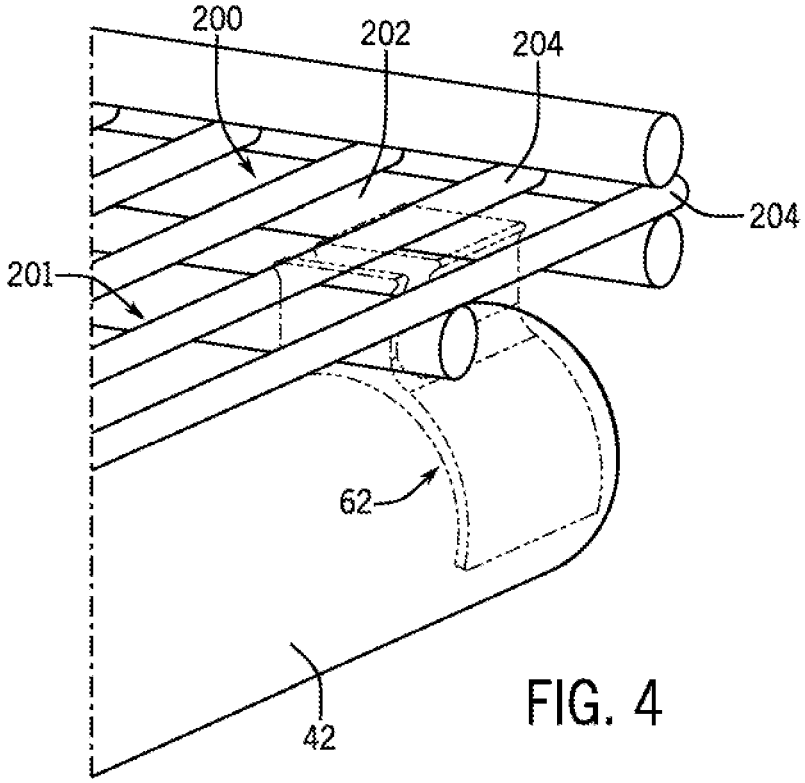
FIG. 4 is a partially broken away perspective view of one exemplary embodiment of a positioning clip on the support rod used with the slatwall storage system of FIG. 1.
Figure 5:
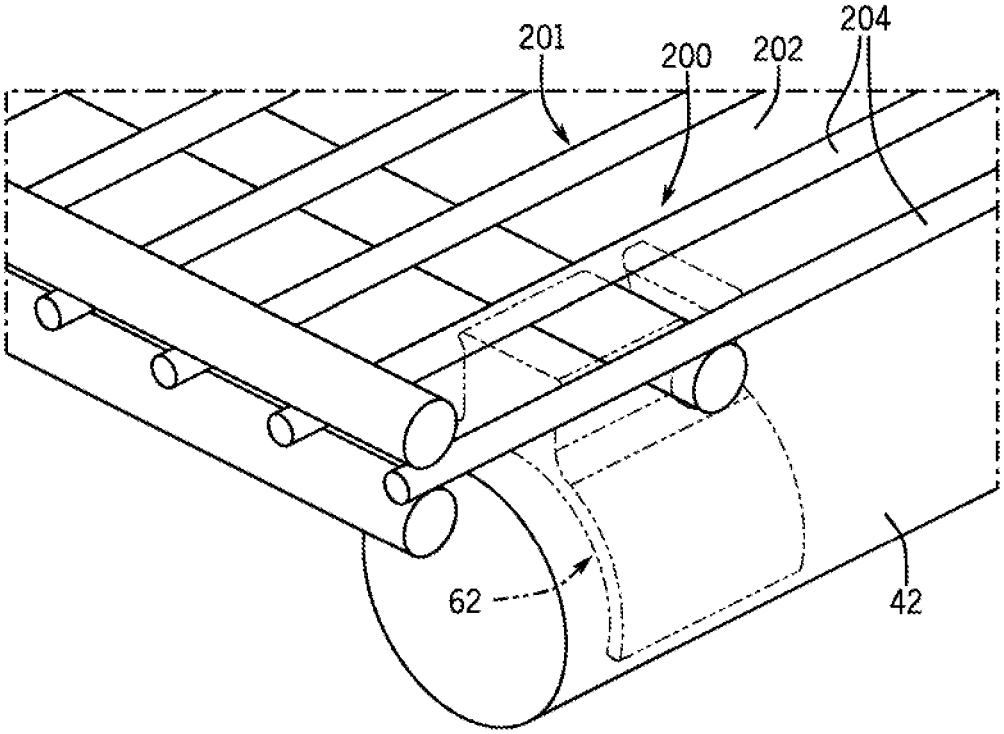
FIG. 5 is a partially broken away perspective view of another exemplary embodiment of positioning clip on the support rod.
Figure 6:
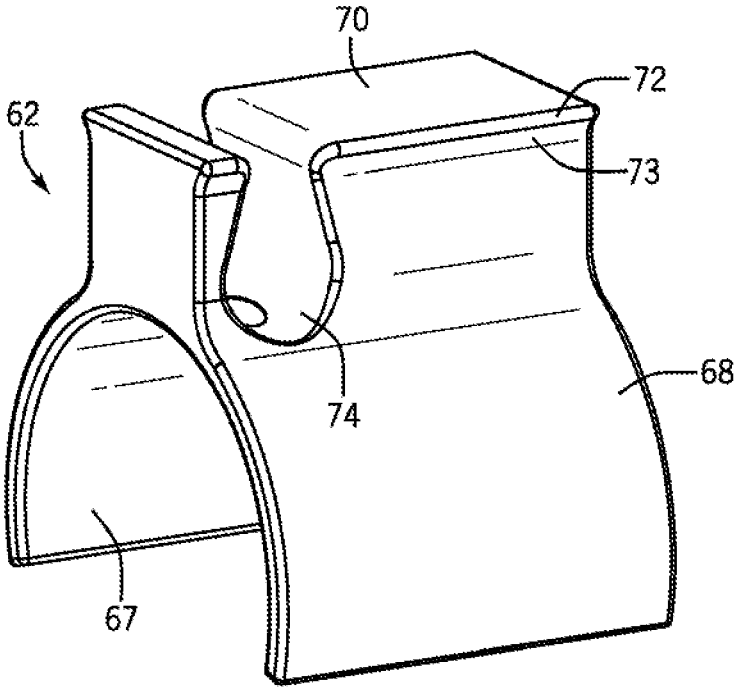
FIG. 6 is a top isometric view of a first embodiment of a positioning clip of the storage system of FIG. 1.
Figure 7:
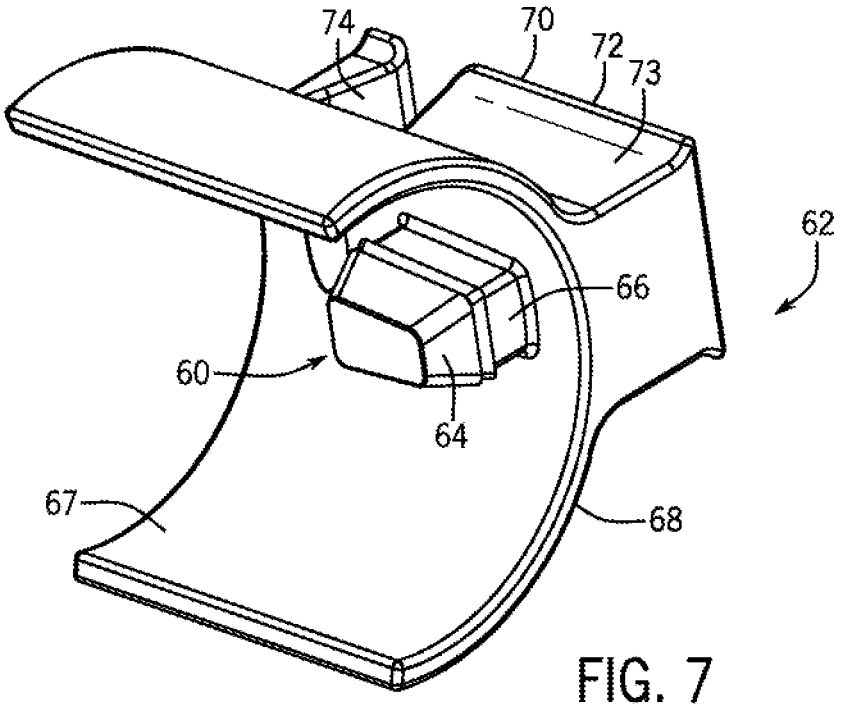
FIG. 7 is a bottom isometric view of the positioning clip of FIG. 6.
Figure 8:
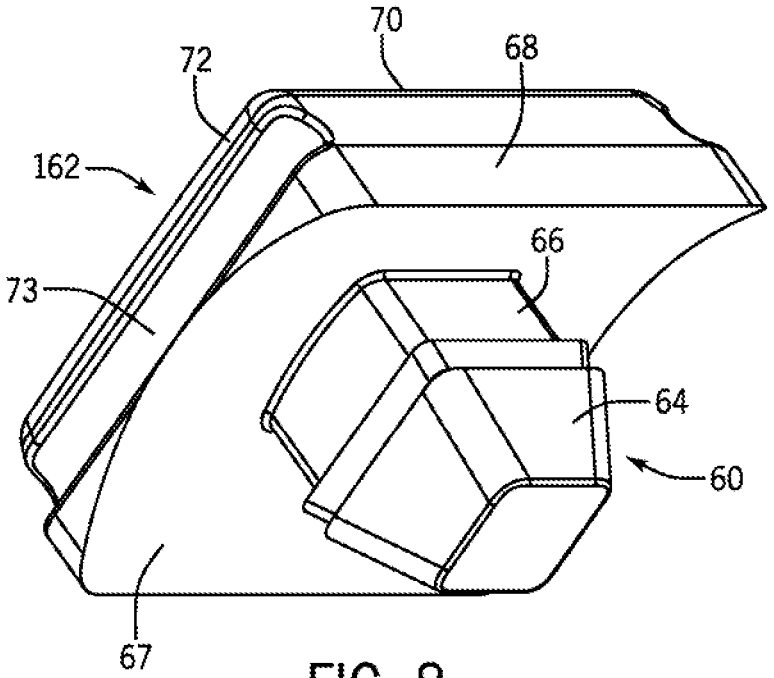
FIG. 8 is a bottom isometric view of a second embodiment of a positioning clip of the storage system of FIG. 1.
Figure 9:
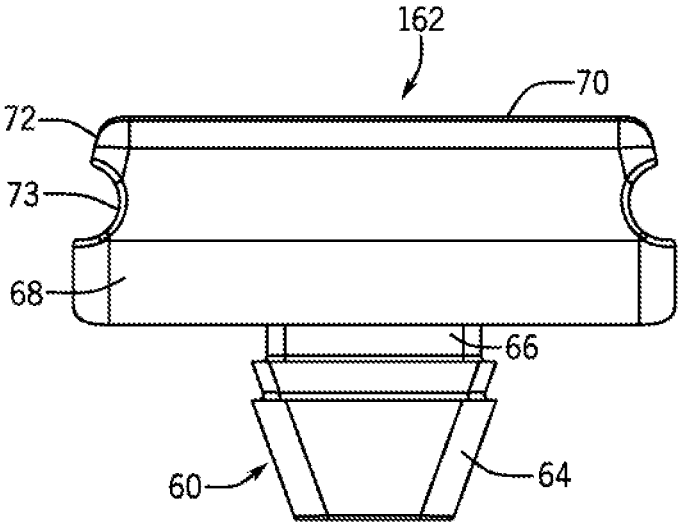
FIG. 9 is a side elevation view of the positioning clip of FIG. 8.
Figure 10:
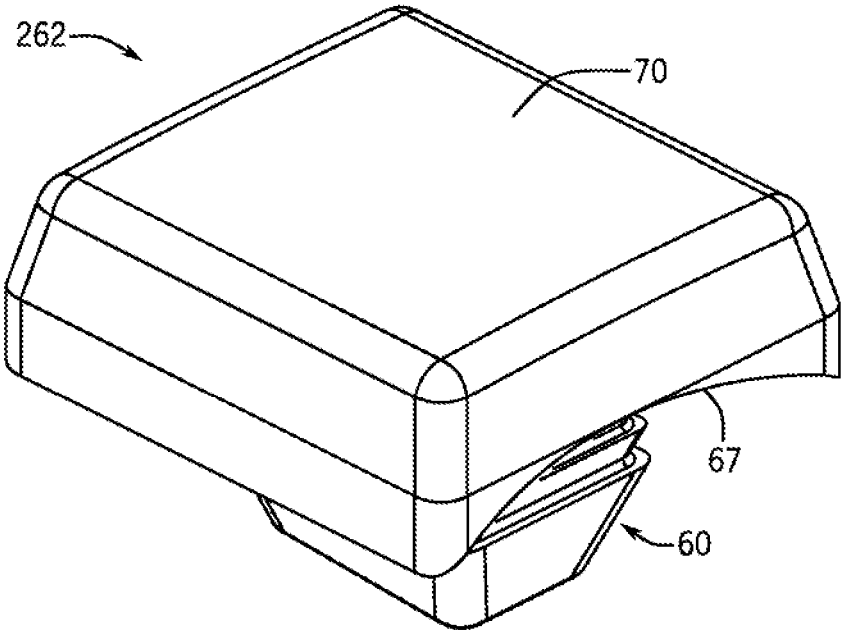
FIG. 10 is a top isometric view of a third embodiment of a positioning clip of the storage system of FIG. 1.
Figure 11:
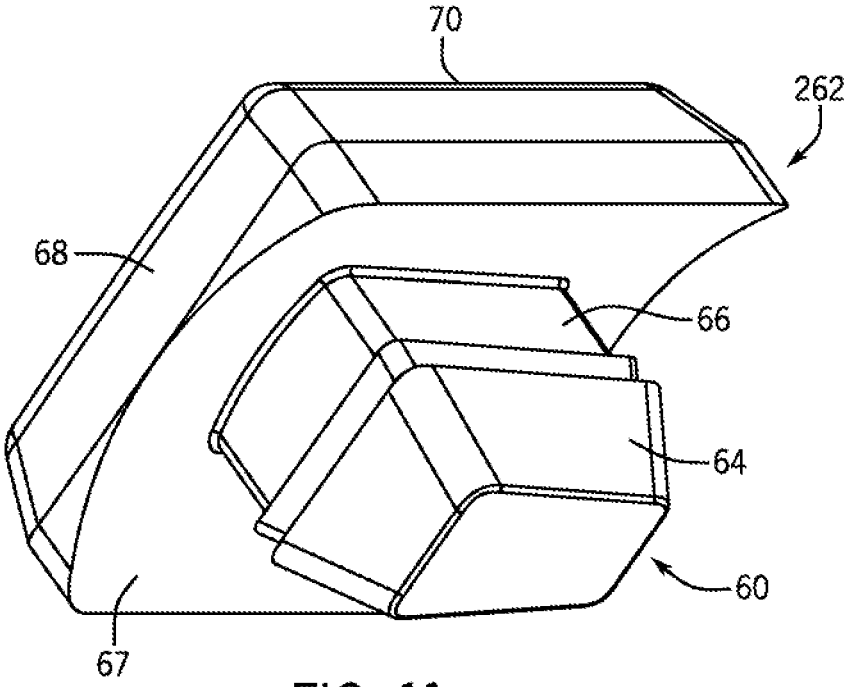
FIG. 11 is a bottom isometric view of the positioning clip of FIG. 10.
Figure 12:
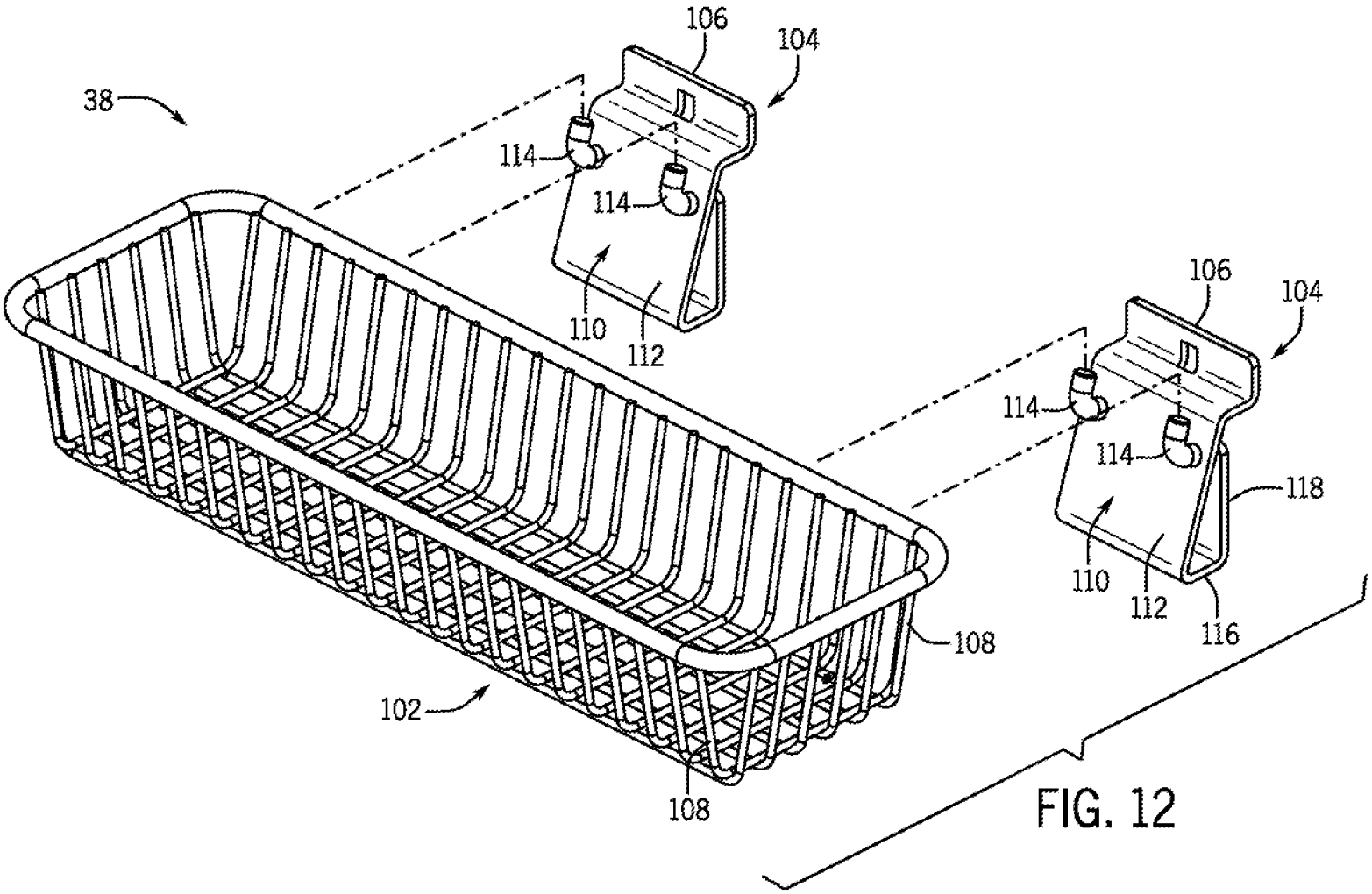
FIG. 12 is an exploded isometric view of a basket clip and basket utilized with the storage system of FIG. 1.
Figure 13:
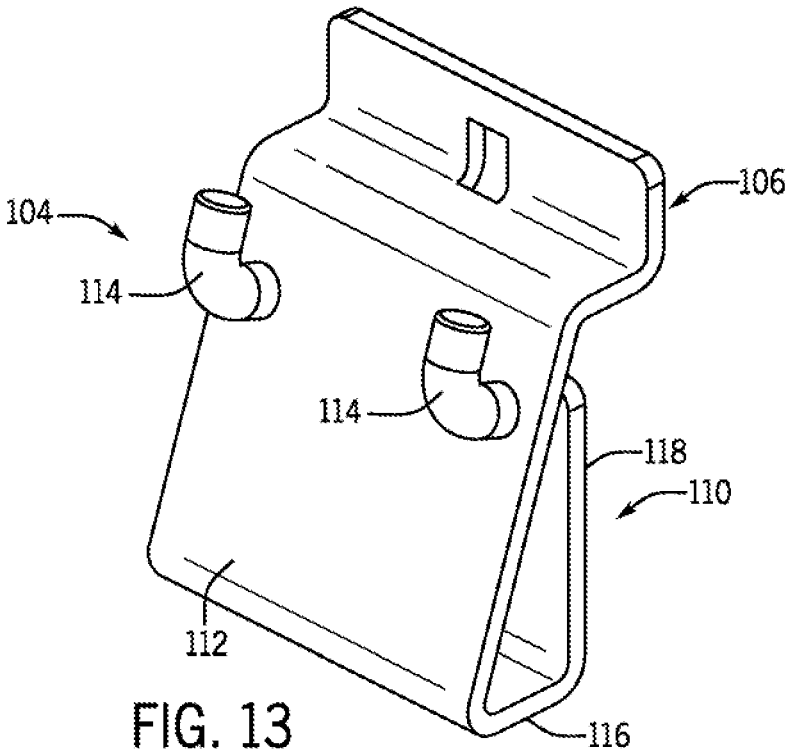
FIG. 13 is an isometric view of the basket clip of FIG. 12.
Figure 14:
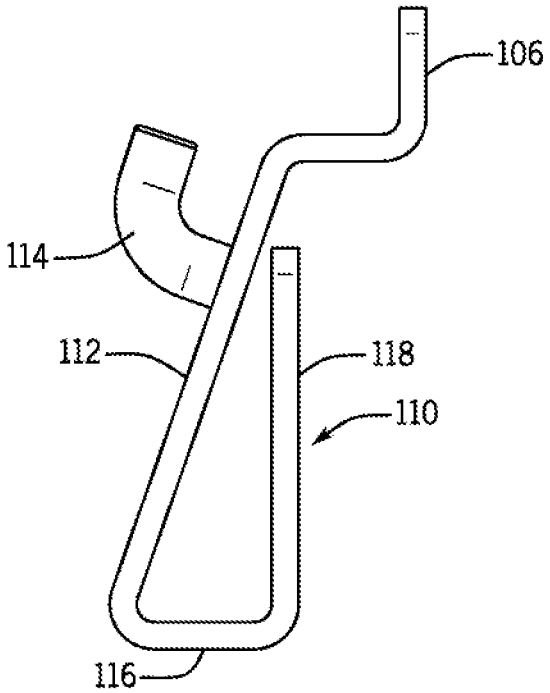
FIG. 14 is a side elevation view of the basket clip of FIG. 13.

Looking at FIG. 3, the bracket 44 may also include a patch 51 located on the base 46 opposite the rod 42. The patch 51 is formed of a material capable of frictionally, adhesively or otherwise engaging the panel 24 to prevent or limit sliding of the bracket 44 relative to the panel 24, such as to prevent the bracket 44 from being inadvertently lifted relative to the panel 24 and becoming disengaged from the slot 26. In one exemplary embodiment, the patch 51 can take the form of an adhesive panel 53 located on the bracket 44.

Looking at FIGS. 2-5, the rod 42 includes one or more apertures 52 disposed on the rod 42 such that the apertures 52 are located on the top 54 of the rod 42 when the bracket 44 to which the rod 42 is secured is engaged with the panel 24. The apertures 52 can have any configuration but in the exemplary illustrated embodiment are formed with a narrow end 56 and a wide end 58.

The apertures 52 receive and engage a stay 60 disposed on a positioning clip 62. The stay 60 is formed to be complementary in shape to the aperture 52 to be received within the aperture 52. In the exemplary illustrated embodiments of the positioning clips 62, 162, 262 of FIGS. 6-11, the stay 60 also includes a tapered end 64 spaced from the clip 62 and a notch 66 formed in the stay 60 adjacent the tapered end 64 to engage the periphery of the aperture 52 and hold the clip 62, 162, 262 on the rod 42.

Referring to the illustrated exemplary embodiment of FIGS. 4-11, the clip 62 includes a body 68 that defines a recess 67 that conforms to the exterior shape of the rod 42 and supports the stay 60 thereon. Opposite the stay 60, the body 68 includes an upwardly extending shelf engagement member 70. The engagement member 70 is shaped to be complementary to the configuration of a shelf 200 secured thereto, and in the embodiment of the clip of FIGS. 4-9, includes a peripheral lip 72 (best shown in FIGS. 8-9) disposed over a recess 73 that engages and secures portions of the shelf 100 to the engagement member 70. The shelf 200, in the illustrated embodiment is a wire form shelf 201, and the recess 73 is inserted in spaces 202 defined between and engaged with adjacent wires 204 forming the shelf 200 to secure the shelf 200 to the structure 70, though other configurations for the shelf 200 are also contemplated as being within the scope of the invention.

In the illustrated exemplary embodiment of FIGS. 4-7, the engagement structure 70 of the clip 62 additionally includes a channel 74 formed in the structure 70 that receives a portion (e.g., wire 204) of the shelf 200 therein, to assist in securing the shelf 200 to the clip 62. In the illustrated exemplary embodiment of FIGS. 10-11, the clip 62 can omit the lip 72 and recess 73 such that the shelf 200 rests on the engagement member 70. In addition, other planar shelf structures (not shown) can be positioned on/over the shelf 200 to form a horizontal surface without apertures for supporting items thereon.

Regardless of the embodiment of the clip 62, 162, 262 used on the rod 42, the clips 62, 162, 262 enable the shelf 100 to be positioned on the rod(s) 42 horizontally or generally perpendicular to the panel 24, such that items not readily hung or disposed vertically on the panel 24.

Referring now to FIGS. 1 and 12-14, the basket assembly 38 includes a basket 102 and a bracket 104 including a tab 106 engageable with a slot 26 in the panel 24. As the basket 102 includes tapered sides 108, the bracket 104 includes a body 110 with an angled portion 112 shaped complementary to the tapered side 108 of the basket 102. A number of hooks 114 extend outwardly from the portion 112 in order to engage and hold the basket 102 on the bracket 104. Opposite the tab 106, the angled portion 112 includes a horizontal portion 116 and a back portion 118 that engages the panel 24 to securely position the bracket 104 and basket 102 on the panel 24.

Various other embodiments of the present invention are contemplated as being within the scope of the filed claims particularly pointing out and distinctly claiming the subject matter regarded as the invention.

I claim:

1. A storage system comprising:

a) at least one vertical wall panel; and b) at least one support assembly engaged with the at least one vertical wall panel, the at least one support assembly adapted to support items thereon in a horizontal orientation, wherein the at least one support assembly comprises:

a) a pair of support rods engaged with the wall panel and spaced from one another;

b) a number of positioning clips engaged with each support rod; and c) a shelf engaged with the positioning clips on the support rods;

wherein the positioning clips include a stay and wherein the at least one support rod further comprises a number of stay-engaging apertures disposed only within a top surface of the rod and within which the stay is positioned to extend into but not completely through the rod.

2. The storage system of claim 1 wherein the at least one support rod comprises a bracket secured to one end of the rod and engaged with the wall panel.

3. The storage system of claim 2 wherein the bracket includes a patch opposite the rod and engaged with the wall panel to limit sliding of the bracket along the wall panel.

4. A storage system comprising:

a) at least one vertical wall panel; and b) at least one support assembly engaged with the at least one vertical wall panel, the at least one support assembly adapted to support items thereon in a horizontal orientation, wherein the at least one support assembly comprises:

a) a pair of support rods engaged with the wall panel and spaced from one another;

b) a number of positioning clips engaged with each support rod; and c) a shelf engaged with the positioning clips on the support rods;

wherein the positioning clip comprises:

a) a body defining a recess complementary to the rod and on which the stay is positioned for engagement with the rod; and b) an attachment structure extending outwardly from the body opposite the stay and engaged between two or more adjacent portions of the shelf.

5. The storage system of claim 4 wherein the attachment structure is inserted between the two or more adjacent portions of the shelf.

6. The storage system of claim 5 wherein the attachment structure includes at least one recess engageable with a portion of the shelf.

7. The storage system of claim 5 wherein the attachment structure includes at least one channel engageable with a portion of the shelf.

8. A support assembly adapted to be engaged with a vertical wall panel to support items thereon in a horizontal orientation, the support assembly comprising:

a) at least one support rod engaged with the wall panel; and b) at least one positioning clip engaged with the at least one support rod, wherein the positioning clips include a stay and wherein the at least one support rod further comprises a number of stay-engaging apertures disposed only within a top surface of the rod and within which the stay is positioned to extend into but not completely through the rod.

9. The support assembly of claim 8 wherein the at least one support rod comprises a bracket secured to one end of the rod and adapted to be engaged with the wall panel.

10. The support assembly of claim 9 wherein the bracket includes a patch opposite the rod and adapted to be engaged with the wall panel to limit sliding of the bracket along the wall panel.

11. A support assembly adapted to be engaged with a vertical wall panel to support items thereon in a horizontal orientation, the support assembly comprising:

a) at least one support rod engaged with the wall panel; and b) at least one positioning clip engaged with the at least one support rod, wherein the positioning clip comprises:

a) a body defining a recess complementary to the rod and on which the stay is positioned for engagement with the rod; and b) an attachment structure extending outwardly from the body opposite the stay and adapted to be engaged between two or more adjacent portions of a shelf.

12. A method for providing increased storage capacity, the method comprising the steps of:

a) providing a storage system having a vertical wall panel; and b) engaging at least one support assembly according to claim 8 or claim 11 with the vertical wall panel, the at least one support assembly adapted to support items thereon in a horizontal orientation.

* * * * *